US007992743B2

(12) United States Patent
Vovan

(10) Patent No.: US 7,992,743 B2
(45) Date of Patent: Aug. 9, 2011

(54) EDGE-TEARING TAMPER-EVIDENT CONTAINER

(75) Inventor: Terry Vovan, Upland, CA (US)

(73) Assignee: PWP Industries, Vernon, CA (US)

( * ) Notice: Subject to any disclaimer, the term of this patent is extended or adjusted under 35 U.S.C. 154(b) by 220 days.

(21) Appl. No.: 12/321,254

(22) Filed: Jan. 20, 2009

(65) Prior Publication Data

US 2009/0223619 A1 Sep. 10, 2009

Related U.S. Application Data

(63) Continuation-in-part of application No. 11/166,308, filed on Jun. 24, 2005, now abandoned.

(51) Int. Cl.
*B65D 6/28* (2006.01)

(52) U.S. Cl. ..... 220/791; 220/4.23; 220/266; 220/377; 220/789

(58) Field of Classification Search ..... 220/4.23, 220/266, 377, 789, 791
See application file for complete search history.

(56) References Cited

U.S. PATENT DOCUMENTS

| | | | |
|---|---|---|---|
| 3,572,579 | A | 3/1971 | Mueller |
| 3,773,207 | A | 11/1973 | Dokoupil et al. |
| 4,006,839 | A | 2/1977 | Thiel et al. |
| 4,091,930 | A | 5/1978 | Buchner et al. |
| 4,113,136 | A | 9/1978 | Abbott |
| 4,433,793 | A | 2/1984 | Ingemann |
| 4,434,907 | A | 3/1984 | Ingemann |
| 4,535,889 | A | 8/1985 | Terauds |
| 4,627,550 | A | 12/1986 | Dines |
| 4,742,935 | A | 5/1988 | Schellenberg |
| 4,759,463 | A | 7/1988 | Mazoin |
| 4,765,463 | A | 8/1988 | Chanel |
| 4,881,656 | A | 11/1989 | Chumley et al. |
| 4,890,758 | A | 1/1990 | Gailus |
| 4,930,656 | A | 6/1990 | Blanchette |
| 4,966,292 | A | 10/1990 | Marino |
| 4,998,622 | A | 3/1991 | Drack |
| 5,002,198 | A | 3/1991 | Smith |

(Continued)

FOREIGN PATENT DOCUMENTS

DE 7816353 11/1978

(Continued)

OTHER PUBLICATIONS

U.S. Appl. No. 11/496,215, filed Nov. 12, 2008 Requirement for Restriction.

(Continued)

*Primary Examiner* — Anthony Stashick
*Assistant Examiner* — Elizabeth Volz
(74) *Attorney, Agent, or Firm* — Baker Botts L.L.P.

(57) ABSTRACT

A food container formed from plastic, can be loaded with food and then closed by a clerk, and thereafter cannot be opened without tearing apart first sides (24, 26) of the base (12) and lid (16). The container is formed by a single sheet of plastic that forms a base and lid with second sides (20, 22) that are latched together and with adjacent first sides that are joined by a joint line (30) in the plastic that is creased and that has slits (40). At the joint line, the lid has a projecting lid tab (32) and the base has a projecting base tab (36). A person grasps both tabs, and lifts only the lid tab to tear apart the first sides of the base and lid along the joint line (30). Thereafter, the lid can be easily closed and reopened on the base.

16 Claims, 6 Drawing Sheets

U.S. PATENT DOCUMENTS

| | | | |
|---|---|---|---|
| 5,007,231 | A | 4/1991 | Ingemann |
| 5,027,969 | A | 7/1991 | Lesquir |
| 5,040,695 | A | 8/1991 | Adams et al. |
| 5,052,574 | A | 10/1991 | McKinnon et al. |
| 5,111,953 | A | 5/1992 | Faust et al. |
| 5,111,954 | A | 5/1992 | Gaudreault |
| 5,115,934 | A | 5/1992 | Nelson |
| 5,129,531 | A | 7/1992 | Beck et al. |
| 5,133,470 | A | 7/1992 | Abrams et al. |
| 5,170,905 | A | 12/1992 | Luch |
| 5,219,074 | A | 6/1993 | Mizuno et al. |
| 5,219,087 | A | 6/1993 | Christensson |
| 5,249,694 | A | 10/1993 | Nelson |
| 5,287,959 | A | 2/1994 | Hansen et al. |
| 5,307,948 | A | 5/1994 | Blackburn et al. |
| D352,000 | S | 11/1994 | Hansen et al. |
| 5,421,473 | A | 6/1995 | McCrossen |
| 5,507,405 | A | 4/1996 | Thomas et al. |
| 5,507,406 | A | 4/1996 | Urciuoli et al. |
| 5,511,679 | A | 4/1996 | Beck |
| 5,528,814 | A | 6/1996 | Luch et al. |
| 5,545,375 | A | 8/1996 | Tropsha et al. |
| 5,573,134 | A | 11/1996 | Chenault et al. |
| 5,607,075 | A | 3/1997 | Burgdorf et al. |
| 5,683,771 | A | 11/1997 | Tropsha |
| 5,842,593 | A | 12/1998 | von Holdt |
| 5,875,913 | A | 3/1999 | Letica |
| 5,897,011 | A | 4/1999 | Brilliant et al. |
| 5,931,332 | A | 8/1999 | Mygatt et al. |
| 5,979,690 | A | 11/1999 | Hartley |
| 6,000,570 | A | 12/1999 | Nelson |
| RE36,729 | E | 6/2000 | Luch et al. |
| 6,116,501 | A | 9/2000 | Hupp |
| 6,135,304 | A | 10/2000 | Wyslotsky |
| 6,168,044 | B1 | 1/2001 | Zettle et al. |
| 6,257,435 | B1 | 7/2001 | Chedister et al. |
| 6,279,774 | B1 | 8/2001 | Clute et al. |
| 6,564,958 | B1 | 5/2003 | Ramsey et al. |
| 6,572,909 | B1 | 6/2003 | Bagwell et al. |
| 6,604,645 | B1 | 8/2003 | Vaupotic |
| 6,772,901 | B2 | 8/2004 | Witt |
| 6,926,165 | B2 | 8/2005 | Conti |
| 7,004,341 | B2 | 2/2006 | Shenkar et al. |
| 7,073,680 | B2 | 7/2006 | Boback et al. |
| 7,097,058 | B2 | 8/2006 | Wellman et al. |
| 7,118,003 | B2 | 10/2006 | Sellari et al. |
| 7,207,457 | B2 | 4/2007 | Schwarz |
| 7,243,813 | B2 | 7/2007 | Krueger |
| 7,311,218 | B2 | 12/2007 | Varadarajan |
| 2003/0052133 | A1 | 3/2003 | Hayes et al. |
| 2003/0160051 | A1 | 8/2003 | Ciccone |
| 2004/0134910 | A1 | 7/2004 | Colombo |
| 2006/0060578 | A1 | 3/2006 | Church et al. |
| 2006/0163265 | A1 | 7/2006 | De Candido |
| 2006/0201946 | A1 | 9/2006 | Witt |
| 2006/0255054 | A1 | 11/2006 | Vovan |
| 2006/0261070 | A1 | 11/2006 | Robertson et al. |
| 2006/0266750 | A1 | 11/2006 | Lesquir |
| 2006/0278652 | A1 | 12/2006 | Vovan et al. |
| 2006/0289541 | A1 | 12/2006 | Boback et al. |
| 2006/0289549 | A1 | 12/2006 | Vovan |
| 2007/0012710 | A1 | 1/2007 | Vovan |
| 2007/0062948 | A1 | 3/2007 | Albrecht et al. |
| 2007/0108210 | A1 | 5/2007 | Alvares et al. |
| 2007/0138046 | A1 | 6/2007 | Vovan |
| 2007/0138180 | A1 | 6/2007 | Vovan |
| 2007/0196541 | A1 | 8/2007 | Vovan et al. |
| 2007/0202221 | A1 | 8/2007 | Hinze et al. |
| 2008/0000904 | A1 | 1/2008 | Vovan |
| 2008/0006632 | A1 | 1/2008 | Vovan |
| 2008/0185383 | A1 | 8/2008 | Philippe et al. |
| 2009/0021026 | A1 | 1/2009 | Collier |
| 2009/0057313 | A1 | 3/2009 | Alvares |
| 2009/0206082 | A1 | 8/2009 | Vovan |

FOREIGN PATENT DOCUMENTS

| | | | |
|---|---|---|---|
| DE | 4418935 | | 12/1995 |
| DE | 1999083197 | | 8/1999 |
| EP | 0752374 | | 1/1997 |
| FR | 2691952 | A1 | 6/1992 |
| FR | 2819496 | A1 | 1/2001 |
| GB | 2257118 | | 1/1993 |
| WO | WO 2005/009857 | A | 2/2005 |

OTHER PUBLICATIONS

U.S. Appl. No. 11/496,215, filed Dec. 4, 2008 Response to Restriction.

U.S. Appl. No. 11/496,215, filed Feb. 10, 2009 Non-Final Office Action.

U.S. Appl. No. 11/496,215, filed Mar 2, 2009 Response to Non-Final Office Action.

U.S. Appl. No. 11/496,215, filed Jun. 1, 2009 Notice of Allowance.

U.S. Appl. No. 11/496,215, filed Jun. 24, 2009 Supplemental Notice of Allowance.

U.S. Appl. No. 12/512,817, filed Oct. 21, 2009 Examiner Interview Summary.

U.S. Appl. No. 12/512,817, filed Nov. 23, 2009 Preliminary Amendment.

U.S. Appl. No. 12/512,817, filed Nov. 23, 2009 Applicant Interview Summary.

U.S. Appl. No. 12/512,817, filed Mar. 15, 2010 Notice of Allowance.

U.S. Appl. No. 12/512,817, filed Mar. 23, 2010 Terminal Disclaimer.

Food container purportedly published in Apr. 2005.

Safer Sandwiches, www.packagingtoday.co.uk—Packaging Today, purportedly published in Apr. 2005.

Tamper Evident Container, dated Sep. 13, 2004 and purportedly exhibited in a foreign country in Apr. 2005.

Tri-Star to Unveil First Ever Tamper Evident Salad Containers at Total Sandwich Show, Sandwich and Snack News, purportedly published in Apr. 2005.

FIG. 5
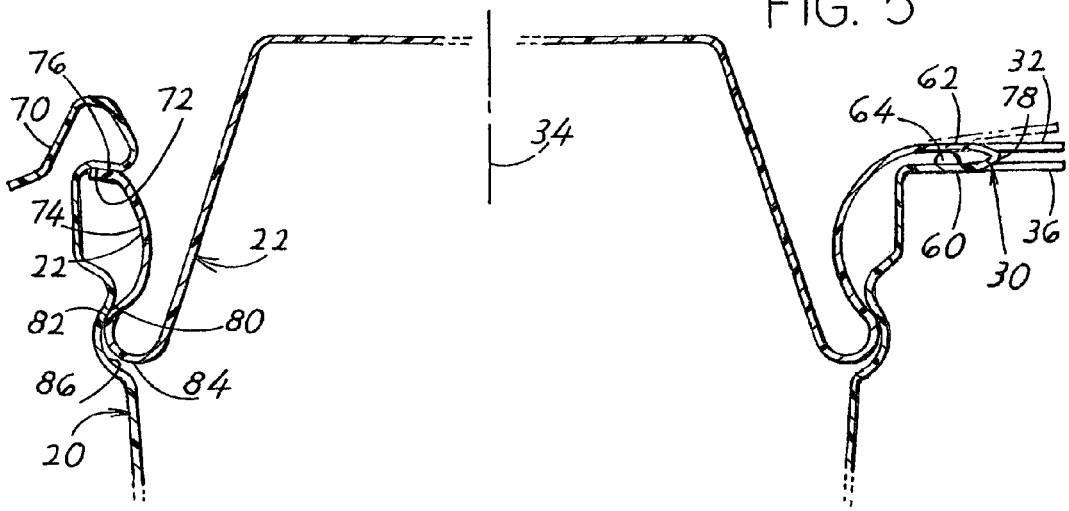
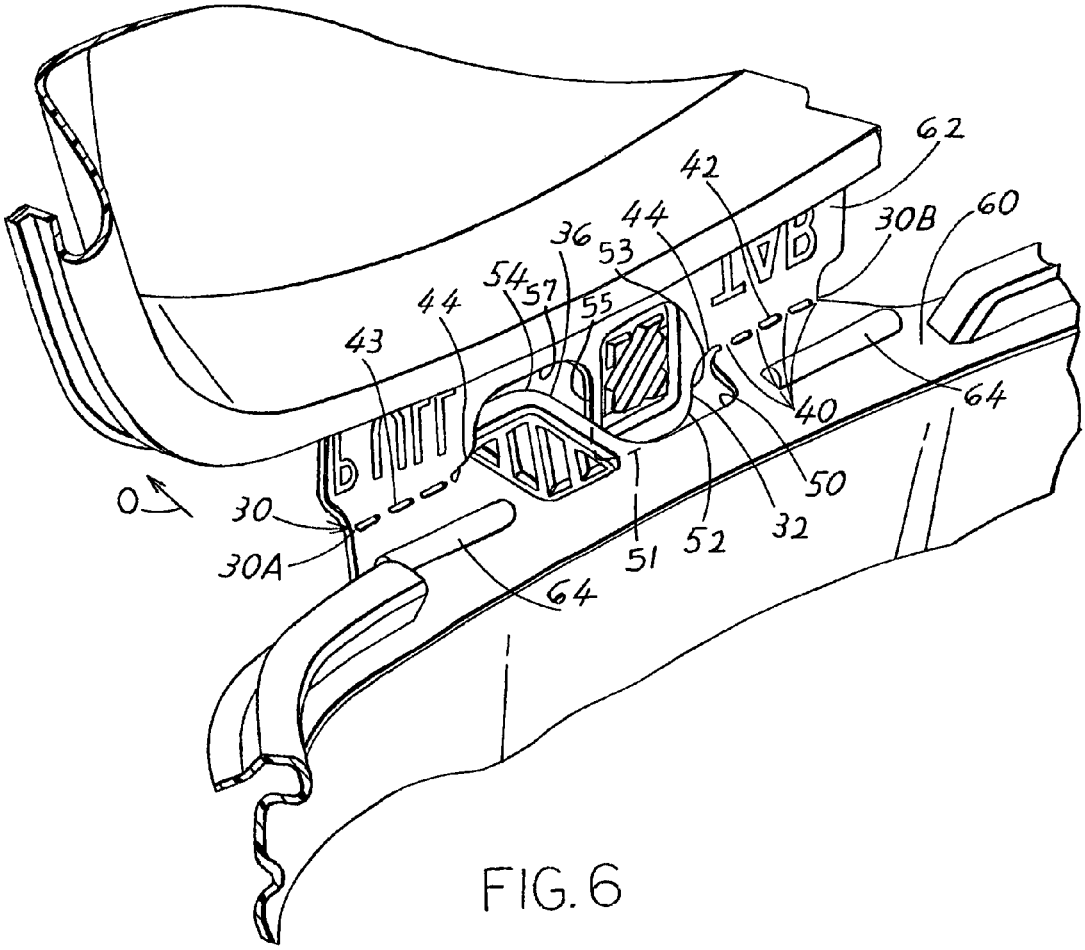
FIG. 6

EDGE-TEARING TAMPER-EVIDENT CONTAINER

CROSS-REFERENCE

This is a continuation-in-part of U.S. patent application Ser. No. 11/166,308 filed Jun. 24, 2005 now abandoned.

BACKGROUND OF THE INVENTION

Food is often placed in a transparent plastic container that includes a base with a large volume cavity that holds the food and with a cover or lid that closes the cavity. Buyers want to be assured that, after the food was placed in the container as by a clerk at the food store, that the container has not been opened. There is a possibility that another customer has secretly opened the container enough to taste a bit of food before closing it (and possibly leaving germs from his/her finger in the food). Potential buyers want to be assured that this has not happened. A container that could be constructed at low cost from plastic, that could be easily initially closed by a clerk at a store after loading goods such as food into the container, and which thereafter required a customer to tear apart parts of the container before initially opening it, would be of value.

SUMMARY OF THE INVENTION

In accordance with one embodiment of the invention, a container is provided that can be constructed at low cost, that can be loaded with goods and initially closed by a clerk at a store, and that thereafter requires a customer to manipulate the container when initially opening it, in a manner that makes it clear that the container was initially opened. The container is constructed of plastic, and preferably of a sheet of plastic that has been formed into the shape of a base having an upwardly-opening cavity for holding goods, and a lid that can close the cavity. The base and lid initially have adjacent first sides and widely-spaced second sides. The first sides are joined by a join line in the plastic sheet that can be easily torn. At the join line, the base and lid have been bent and the bend has been creased, so rim portions of the base and lid lie facewise adjacent to each other. A bump is formed in one of the rim portions to slightly separate the base and lid rim portions.

A clerk loads food into the cavity of the base, and moves the second sides of the container together so they latch together. The second sides latch together to close the container, in a manner that prevents their initial separation. With the second sides of the base and lid latched together and the first sides joined along a join line that must be torn to separate the first sides, the container is securely initially closed. In this condition, the goods in the container cannot be readily touched or sampled by a customer. For a buyer of the container to initially open the container, the buyer must tear apart the first sides of the base and lid along the join line. The join line is weakened, as by a series of slits, so it can be more easily torn apart.

The first sides of the base and lid are formed with a tab in the lid that can be pulled up to tear the join line while the base is held down. The base can be held down by a person grasping a base tab that is horizontally spaced from the lid tab. The outer end of the lid tab, which lies furthest from the container vertical axis, is formed out of material in a flat rim of the first side of the base, to thereby leave a cutout in the base under the lid tab.

The novel features of the invention are set forth with particularity in the appended claims. The invention will be best understood from the following description when read in conjunction with the accompanying drawings.

DESCRIPTION OF THE DRAWINGS

FIG. 5 is a sectional view taken on line 5-5 of FIG. 1.

FIG. 6 is an enlarged isometric view of a portion of the container of FIG. 3.

DESCRIPTION OF THE PREFERRED EMBODIMENTS

Figure 1:
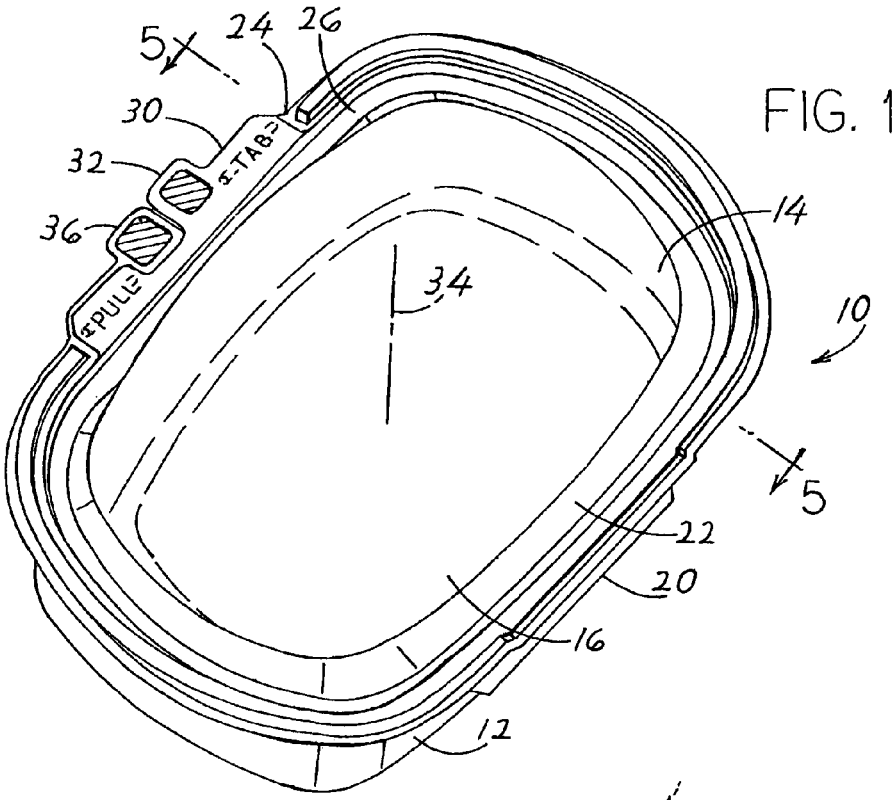
FIG. 1 is a top and rear isometric view of a container of a first embodiment of the invention in its initially closed position.
Figure 2:
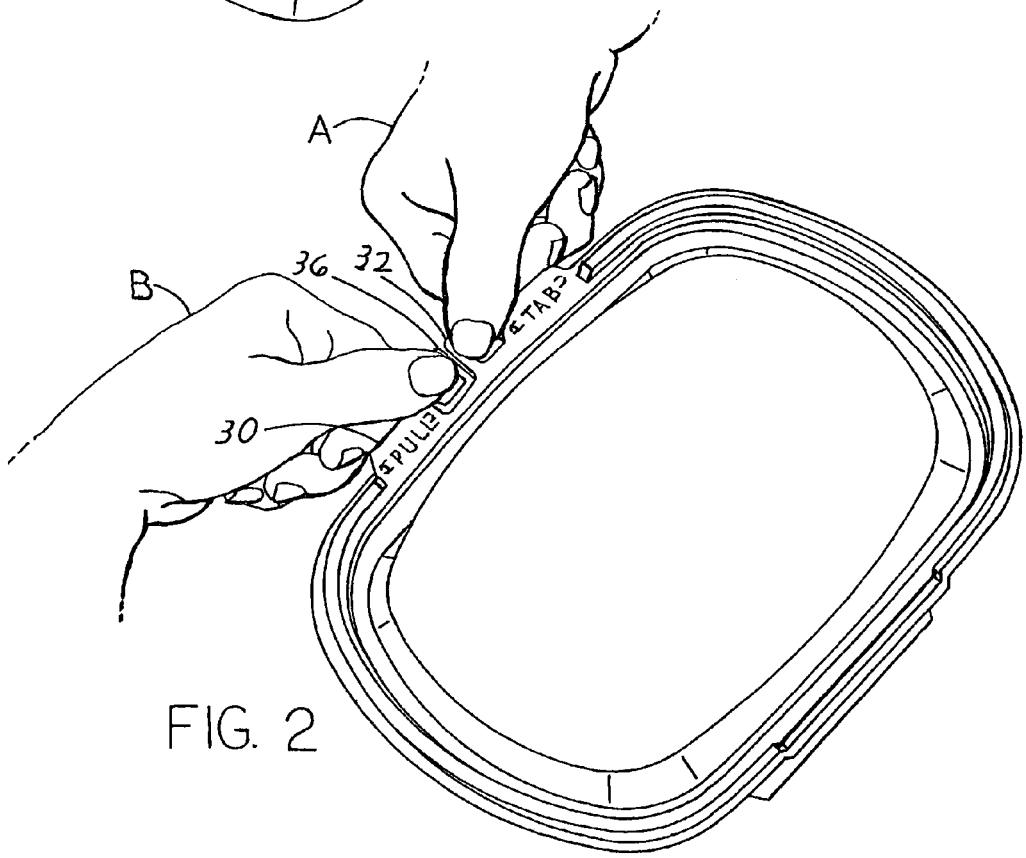
FIG. 2 is a view similar to that of FIG. 1, but showing a person initially opening the container.

FIG. 1 illustrates a container 10 of the present invention, which includes a base 12 with an upwardly-opening cavity 14 for holding goods such as food, and a lid 16 that closes the top of the cavity. The base and lid of FIG. 1 are preferably formed of a single sheet of plastic that has been thermoformed as by vacuum forming, transfer molding or blow molding. It is even possible to injection mold the container to form a container comprising a plastic sheet. The base and lid have second sides 20, 22 that are securely held to each other so the second sides cannot be separated until after first sides 24, 26 have been separated. The first sides 24, 26 of the base and lid are initially fixed together along a join line 30 formed in an integral portion of the plastic sheet, that can be easily torn. Along the first sides, the lid has a lid tab 32 that projects radially outward with respect to the container vertical axis 34 and the base has a projecting base tab 36. As shown in FIG. 2, the container can be initially opened by a person grasping the lid tab 32 between the thumb and index fingers of a first hand A and lifting the lid tab. At the same time, the person can hold down the base by grasping the base tab 36 between the thumb and index fingers of the person's other hand B. Such lifting causes the lid and base to tear apart along the join line 30. The join line can be straight or curved or jagged.

Figure 3:
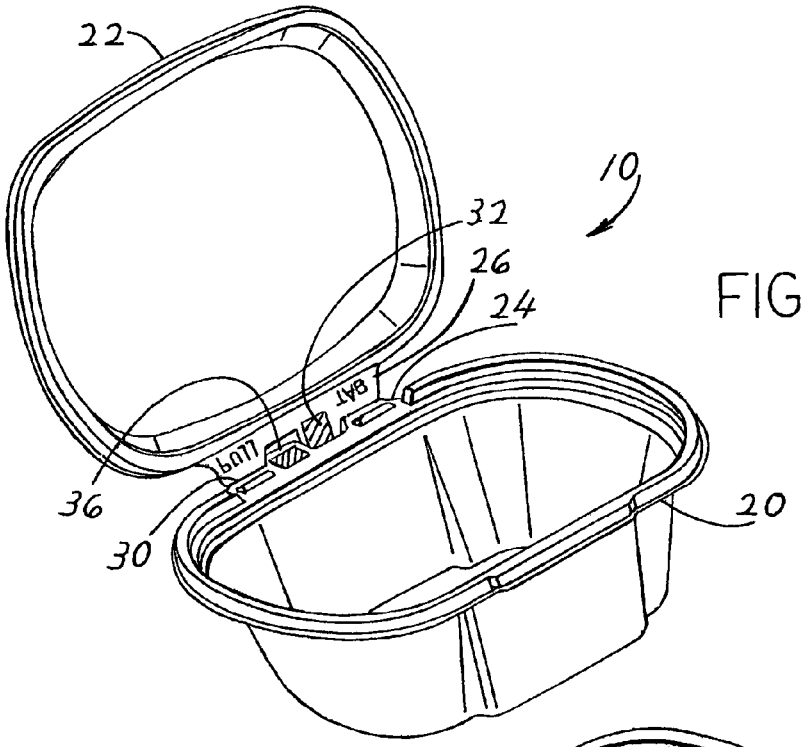
FIG. 3 is a top and rear isometric view of the container of FIG. 1, showing the container prior to its initial closing, and with the lid raised.
Figure 4:
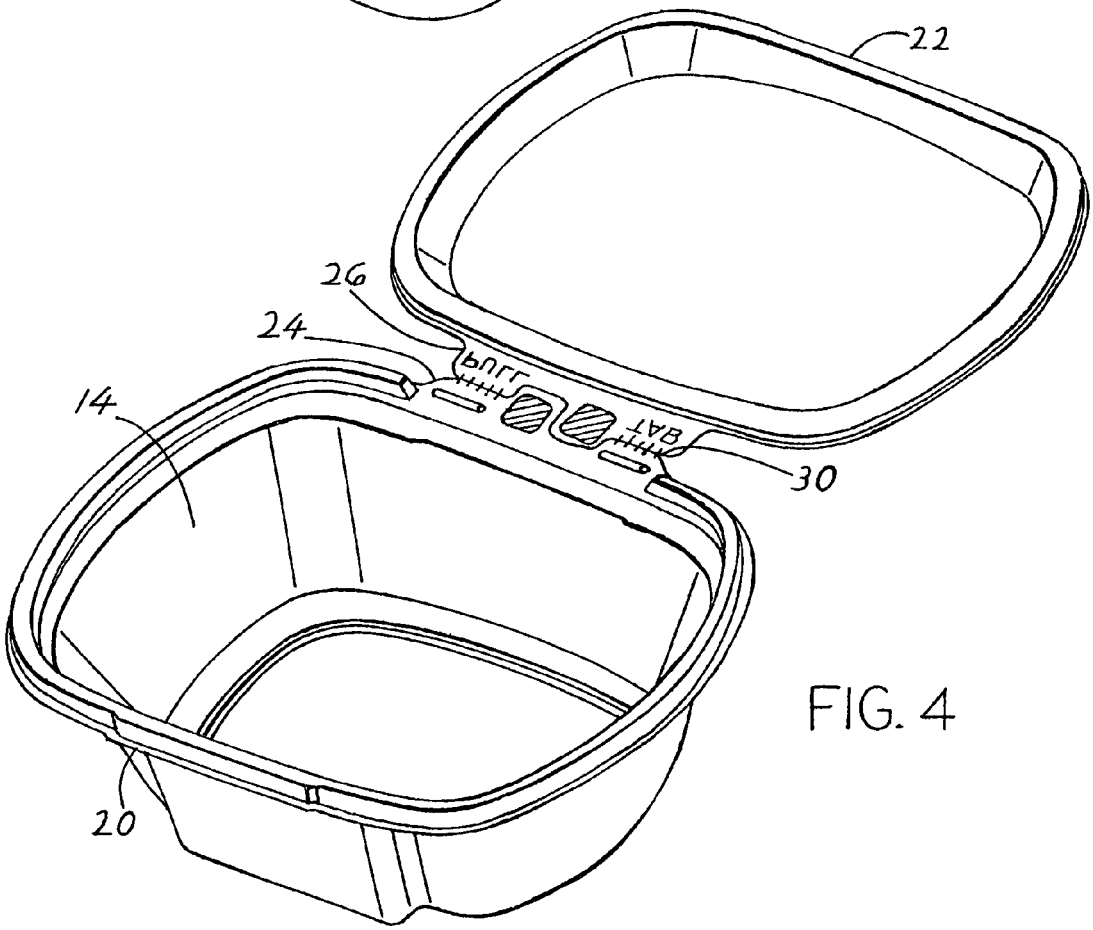
FIG. 4 is top and rear isometric view of the container of FIG. 3, with the lid in its fully open position prior to its initial closing, and showing the container as its is initially vacuum formed.

FIGS. 3 and 4 show the container 10 as it is supplied to a store, and before a store clerk has loaded goods into the container and initially closed the container. The first sides 24, 26 of the base and lid are joined along the join line 30, but the second sides 20, 22 are separated. The base and lid are in the form of thin plastic, or plastic sheeting, and preferably are parts of the same sheet of plastic (which may have portions of different thickness). The join line is formed in an integral sheet of plastic. FIG. 4 shows the container as it is initially formed from a single sheet of thermoformed plastic which has been thermoformed to the illustrated shape, and with slits cut along the join line 30. The lid is folded, or bent 180° from FIG. 4 to achieve the initially closed position of FIGS. 1 and 2.

FIG. 6 shows the first sides of the base and lid, showing that the join line 30 includes opposite join line parts 30A and 30B that lie on opposite sides of the lid and base tabs 32, 36. Along each join line part there are four join lengths 40 and an interrupted slit 42 with slit parts. Applicant prefers to provide join lengths 40 each of no more than 0.25 inch length. Leading to each join line part 30A, 30B is an entrance slit 44 of an end width of the same order of magnitude as the slit 42, that leads from the tabs 32, 36 to the join line parts, to concentrate separation forces along the join line parts. In addition, the plastic sheet has been creased (by forming a sharp bend such as a bend having a radius of curvature no more than the thickness of the two sheet portions being bent) to weaken it along the join line.

It can be seen in FIG. 6 that the lid tab 32 has a radially outward O (with respect to the container axis 34) extension 52 that projects beyond the join line 30. The base has a cutout 50 initially lying around the lid extension 52 (when the lid is pivoted 180° from its closed position to the open position in which it is manufactured, in FIG. 4). The lid tab 32 (FIG. 6) is formed by the cutout 50 which extends continuously to leave a lid tab radially outer end 51 and a pair of circumferentially opposite tab sides 53, 55. One of the tab sides 53 ends in the entrance slit 44 that leads to the join line part 30B. The other tab side 55 forms a base tab cutout 57 that leaves a base tab 36.

The base tab 36 has an extension 54 similar to the lid tab extension 52. The lid forms cutout 57 around the base extension. This provides longer tabs that can be more easily grasped and provides cutouts lying under or over the tabs. Also, these cutouts 50, 57 result in no scrap plastic sheet to throw away. FIG. 6 also shows that the first sides of the base and lid form join rim parts 60, 62 that are each flat and that lie facewise adjacent to each other when the lid is closed on the base. The rim part 60 of the base has bumps 64 that assure slight separation of the rim portions after the join line is torn.

A clerk at a store receives a stack of containers in the configuration shown in FIG. 4, with the first sides 24, 26 of the base and lid joined and with the second sides 20, 22 widely separated. The clerk first loads goods such as food into the cavity 14 of the base, and then pivots the lid so its second side lies over the base second side. The clerk then forces the lid second side downward to lock, or latch it to the base second side, to place the container in an initially closed configuration. FIGS. 1 and 2 show the container in such initially closed configuration.

FIG. 5 shows the first and second sides of the base and lid after the lid has been initially closed on the base. The second side 20 of the base has a free rim 70 with a downwardly-facing shoulder 72, and the second side 22 of the lid has a free rim 74 with an upwardly-facing shoulder 76 that abuts the base shoulder 72 to latch the container second side closed. The base and rim also have sealing surfaces 80, 82 that abut to prevent the leakage of liquids and that keep the lid closed after the initial opening but allow opening with a small force such as less than one pound. When the clerk presses down the lid on the base during initial closing of the container, the lid moves down until stopped by a lid limit surface 84 abutting the base limit surface 86, and the lid moves up slightly to its final closed position shown in FIG. 5. In that position, the shoulder 76 on the lid free rim 74 abuts the base shoulder 72 to thereafter prevent the lid second side from being lifted while allowing the lid to be pivoted. The same lid and base sealing surfaces and shoulders extend around the entire container, except that the shoulders 72, 76 are not present below the portion of the first side of the base and lid that lies below the join line and the tabs.

It would be possible to fix the second sides of the lid and base to each other in a true pivot joint, as by sonically welding the top and bottom of a strip of flexible sheet plastic material to the base and lid, although that is not necessary. FIG. 5 shows that the flat rim parts 60, 62 that lie along the joining line 30, lie facewise adjacent to each other with only the bumps 64 separating them, and also shows the crease line 78.

There are no tabs or other projections at the lid second side 20 that can be grasped to pull it up. Accordingly, after the clerk has initially closed the lid on the base, the only way for a customer to open the container is for the customer to tear the plastic sheet along the join line 30, as by forcefully lifting the lid tab 32 while holding down the base (as by holding the base tab 36). When the customer tears the plastic sheet along the join line, he/she thereafter can easily close the container, and can reopen the container by lifting the lift tab 32 with a small force (e.g. less than one pound). When the first side of the container is opened by lifting the lid tab 32, the second side of the lid can slide slightly towards the first side so the lid shoulder 74 does not lie under the base shoulder and therefore the lid can be easily completely separated from the base.

Figure 7:
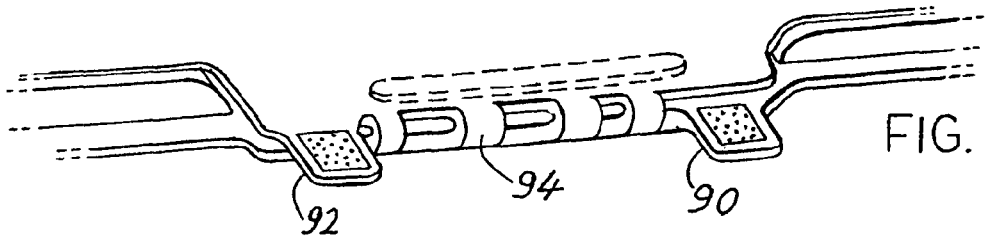
FIG. 7 a partial isometric view of a first side of a container of another embodiment of the invention, wherein base and lid tabs lie on opposite sides of a join line, with the container in its initially closed position.
Figure 8:
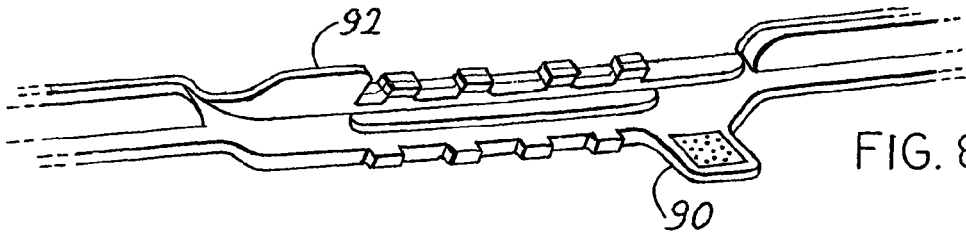
FIG. 8 is a view similar to that of FIG. 7, but with the container in the configuration it achieves after an initial opening.
Figure 9:
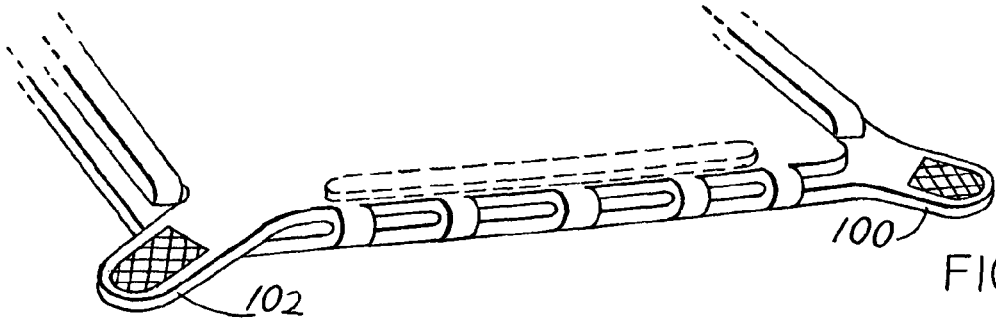
FIG. 9 is a partial isometric view of a first side of a container of another embodiment of the invention, wherein the base and lid tabs lie at opposite corners of the first side of the container, with the container in its initially closed position.
Figure 10:
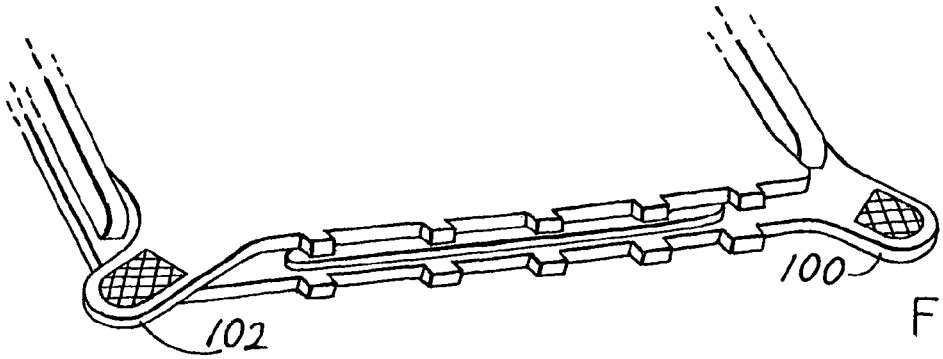
FIG. 10 is a view similar to that of FIG. 9, but with the container in the configuration it achieves after an initial opening.

FIG. 7 shows another embodiment of the invention wherein the base and lid tabs 90, 92 lie on opposite sides of an uninterrupted join line 94. In FIG. 7 the join line 94 has not been torn, while FIG. 8 shows the join line torn as a result of an initial opening of the container. FIGS. 9 and 10, show another embodiment of the invention wherein the base and lid tabs 100, 102 lie at corners of a container of rectangular shape (as seen in a plan view), at opposite ends of the first side of the container.

Figure 13:
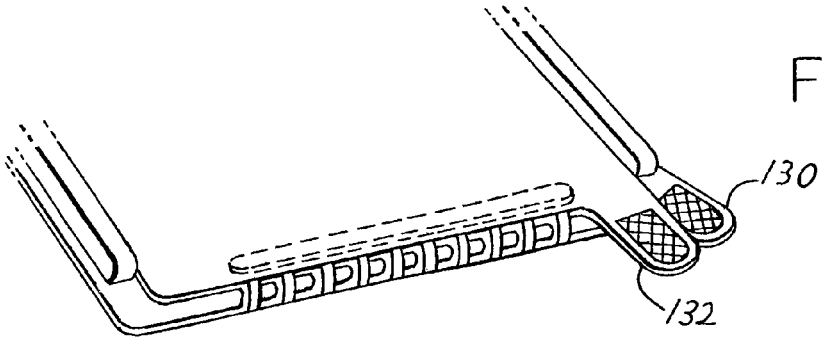
FIG. 13 is a partial isometric view of a container of another embodiment of the invention which is similar to FIG. 9, but with the base and lid tabs at the same corner of the container.
Figure 14:
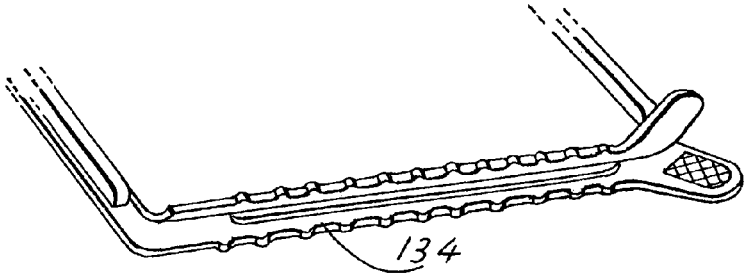
FIG. 14 is a view similar to FIG. 13 after an initial container opening.
Figure 15:
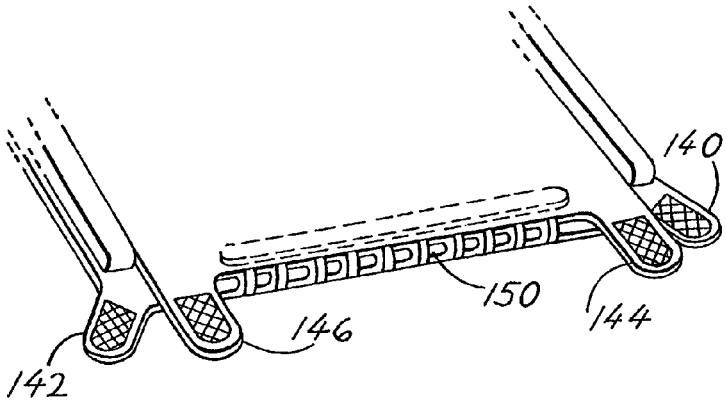
FIG. 15 is a view of a container similar to that of FIG. 13 but with base and lid tabs at each of two corners.
Figure 16:
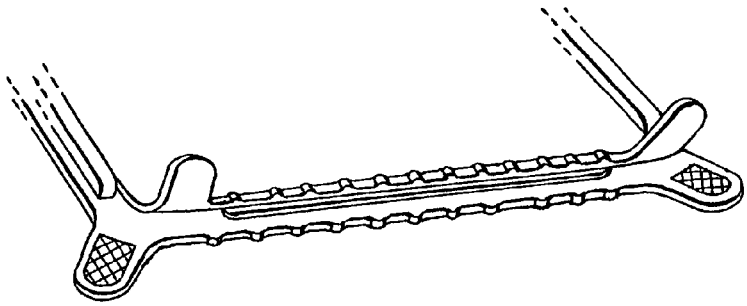
FIG. 16 is a view similar to that of FIG. 14, after an initial container opening.

FIG. 13 shows another container wherein the base and lid tabs 130, 132 lie one above the other, and at a corner of a container. In FIG. 14 the join line 134 has been torn as a result of an initial opening, and the lid tab has been bent to extend at an upward incline. FIG. 15 shows a pair of base and lid tabs 140, 142, 144, 146 at opposite ends of a join line 150. FIG. 16 shows the container of FIG. 15 after the lid tabs have been pulled up and the join line has been torn.

Figure 11:
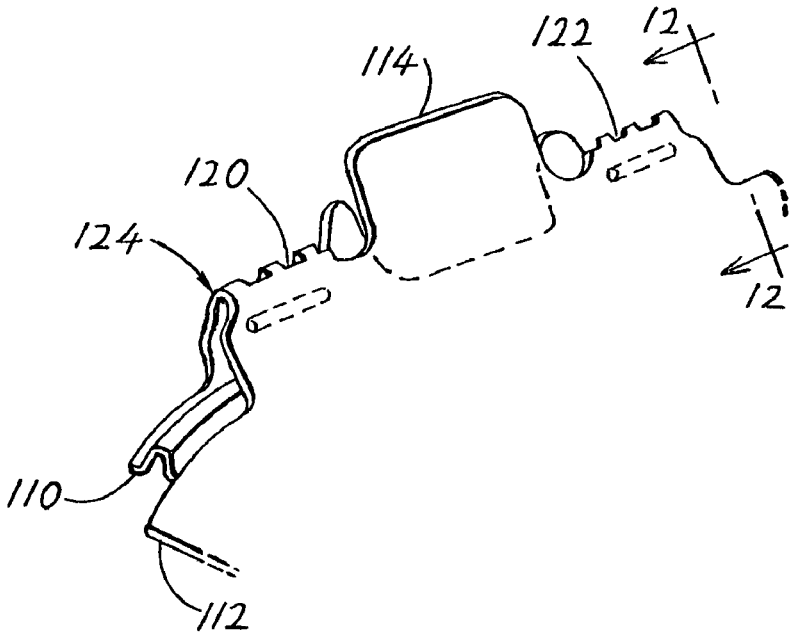
FIG. 11 is a partial isometric view of a container of another embodiment of the invention, which has a lid tab but no base tab.
Figure 12:
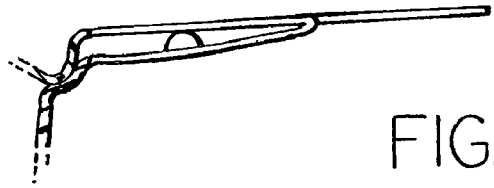
FIG. 12 is a sectional view taken on line 12-12 of FIG. 11.

FIG. 11 shows a portion of a base 110 and lid 112 of a round (of circular or oval configuration as seen in a plan view) container, with only a lid tab 114 between opposite portion 120, 122 of a join line 124. A person grasps the base with one hand while lifting the lid tab 114 with the other hand to tear the join line to initially open the container (that is, to first open the container after it was initially closed).

The container can be formed from a wide variety of polymers, including polystyrene, polypropylene, polyethylene terephthate, etc. Instead of a container of primarily rectangular shape as illustrated in a plan view, the container may be circular, elliptical, or of any reasonable polygonal shape. The base (and cover) can have walls forming compartments, and the container can include a middle tray.

Thus, the invention provides a container comprising a base and lid that can be constructed at low cost, that can be shipped to a store with its cavity open to enable easy loading of food or other goods by a store clerk, and that can be easily closed by the store clerk. The base and lid are preferably formed of a single sheet of plastic, and are joined by a join line that can be torn. After initial closing by the store clerk, the container strongly resists initial opening, to greatly discourage customers from secretly opening the container as to taste food in it. Instead, initial opening requires forceful opening by lifting a tab on the lid to tear the plastic sheet along the join line. Once the container has been initially opened, the fact that it has been initially opened is evident to anyone who looks at the container, which assures buyers that the container is intact. The container thereafter can be easily opened and closed. The plastic sheet that forms the container has a crease along the tear line, and has a narrow slit leading to the tear line. The lid tab extends axially outward beyond the join line by leaving a cutout when it is formed in the plastic sheet.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A method for forming a container out of a plastic sheet comprising:

forming a single plastic sheet into base and lid parts with adjacent first sides that are joined by a single join line;

bringing second sides of said base and lid together and coupling said second sides so the second side of the lid resists upward movement away from said base second side but said lid second side can pivot to allow said lid to pivot open when said first side of said lid is lifted after tearing said plastic sheet along said join line;

wherein forming a plastic sheet with a join line includes weakening said plastic sheet along said join line by folding it along said join line to facilitate tearing apart said base and lid along said join line.

2. The method described in claim 1 including:

creasing said plastic sheet along said join line.

3. The method described in claim 1 wherein:

said container has an axis;

and further wherein forming a plastic sheet into base and lid parts with adjacent first sides that are joined by a join line includes:

cutting apart said first sides of said base and lid except along said join line when the lid is open on the base; and leaving a lid tab in said lid part so a portion of said lid tab will project from said lid part radially outward away from said axis beyond said join line when said lid is closed on said base.

4. The method described in claim 3 wherein:

said container has an axis;

and further wherein forming a plastic sheet into base and lid parts includes:

forming said first side of said lid with a lid tab having a lid tab radially outer end that extends radially outward beyond said join line when said container is closed; and forming said first side of said base with a lid tab cutout under said lid tab by carrying out said step of forming a lid tab by cutting said lid tab to leave said lid tab cutout when said container is open.

5. The method described in claim 4 wherein forming a plastic sheet into base and lid parts includes:

forming said first side of said base with a base tab that has a free end that extends radially outward beyond said join line; and forming said first side of said lid with a cutout that lies over said base tab when said container is open by cutting said base tab out of an edge portion of said lid first side.

6. The method described in claim 5 wherein:

said join line has opposite join line parts;

and further wherein forming said first side of said base with a base tab includes:

forming a base tab cutout with one end thereof that merges with a first of said join line parts and with an opposite end thereof that merges with said lid tab cutout; and forming said lid tab cutout so an end thereof opposite said base tab merges with a second of said join line parts.

7. A method for forming a container with a base and lid from a plastic sheet, wherein when the lid is closed on the base a lid second side is pivotal on a base second side to open and close the lid but the lid second side cannot be readily lifted off the base second side, and a lid first side opposite the lid second side can be lifted off a base first side by lifting a lid tab to tear apart the base and lid first sides and to then lift the lid first side, comprising:

forming said base and lid first sides so they are integral but with a tearable join line that joins said first sides, said join line being tearable to separate said base and lid first sides;

forming said lid tab by cutting a portion of said lid second side from said base second side along a lid tab cutout that extends along a lid tab radially outer end and along portions of circumferentially opposite tab sides that lie radially outward of said join line when the lid is closed on the base, by taking said plastic sheet and cutting said lid first side from said base first side when said lid is open on said base, so when said lid is closed said lid tab lies over said cutout.

8. The method described in claim 7 wherein:

cutting said lid second side from said base along a lid tab cutout to form said lid tab includes extending said lid tab cutout to form a base tab cutout that severs a base tab from said lid tab to leave said base tab lying adjacent to said lid tab with said base tab cutout extending to said join line;

and further wherein forming said join line comprises forming said join line with a pair of separated join line parts with said lid tab and base tab lying between said join line parts.

9. The method described in claim 7 including:

forming a base tab at an end of said join line which is opposite said lid tab.

10. A container having a vertical axis and comprising a base and lid formed of a sheet of plastic, the base and lid each having first and second sides and the second sides of the base and lid are latched together to prevent initial opening threat, said container forming an arrangement at said first side of the base and lid that requires a lift force on the lid and a hold-down force on the base to initially separate the lid first side from the base first side, but after the initial separation followed by closing of the lid it requires a smaller lift force to separate the lid first side from the base first side, wherein:

said container comprises a join line that must be torn to separate said first side of said base and lid from each other with said join line being weakened to facilitate tearing along said join line;

at said first side of said lid and base, said base has a base tab with a base tab portion that projects radially outward beyond said join line.

11. The container describes in claim 10 wherein:

said lid has a cutout, and said base tab portion initially lies in said cutout when said lid has been pivoted 180° from a position wherein said lid is closed on said base.

12. The container described in claim 10 wherein:

said join line has join line parts with an interruption between said join line parts and with said base tab lying in said interruption.

13. The container described in claim 10 wherein:

along said join line said sheet of plastic has slits and join lengths between pairs of slits.

14. A container having a vertical axis and comprising a base and lid formed of a sheet of plastic, the base and lid each having first and second sides and the second sides of the base and lid are latched together to prevent initial opening threat, said container forming an arrangement at said first side of the base and lid that requires a lift force on the lid and a hold-down force on the base to initially separate the lid first side from the base first side, but after the initial separation followed by closing of the lid it requires a smaller lift force to separate the lid first side from the base first side, wherein:

said container comprises a join line that must be torn to separate said first side of said base and lid from each other with said join line being weakened to facilitate tearing along said join line;

at said first side of said lid and base, said base has a base tab with a base tab extension that projects radially outward beyond said join line, to enable said base tab to be grasped to hold down said base first side, and said lid has a cutout corresponding to said base tab;

at said first side of said lid and base, said lid has a lid tab with a lid tab extension that projects radially outward beyond said join line when said lid is closed on said base, and said base has a cutout corresponding to said lid tab.

15. The container described in claim 14 wherein:

said join line includes a pair of join line parts that are separated, with said base tab and lid tab lying between said join line parts.

16. A method for forming a container with a base and lid from a plastic sheet, wherein when the lid is closed on the base, a lid second side is pivotal on a base second side to open and close the lid but the lid second side cannot be readily lifted off the base second side, said lid having a lid first side opposite the lid second side that can be lifted off a base first side by tearing to separate the base and lid first sides and lifting the lid first side while holding down the base first side, comprising:

forming said base and lid first sides with a tearable join line that lies between them;

forming said base tab by cutting a portion of said base first side from said lid first side to leave a lid cutout, said base tab having a base tab extension that lies radially outward of said join line when the lid is closed on the base.

* * * * *